US005823087A

United States Patent [19]

Eigenmann

[11] Patent Number: 5,823,087

[45] Date of Patent: Oct. 20, 1998

[54] PUNCH PRESS HAVING A TOGGLE JOINT MECHANISM DRIVE

[75] Inventor: Oskar Eigenmann, Arbon, Switzerland

[73] Assignee: Bruderer AG, Frasnacht, Switzerland

[21] Appl. No.: 717,215

[22] Filed: Sep. 26, 1996

[30] Foreign Application Priority Data

Sep. 27, 1995 [EP] European Pat. Off. ..... 95115190

[51] Int. Cl.[6] ..... B26D 5/18; B30B 15/14

[52] U.S. Cl. ..... 83/630; 83/628; 83/635; 83/637; 100/208; 100/209

[58] Field of Search ..... 83/630, 628, 624, 83/635, 637, 615, 527, 618; 100/208, 209, 193, 285, 286

[56] References Cited

U.S. PATENT DOCUMENTS

| | | | |
|---|---|---|---|
| 362,566 | 5/1887 | Beaudry | 83/618 |
| 627,598 | 6/1899 | Seybold | 83/624 |
| 1,342,879 | 6/1920 | Thomas | 83/618 |
| 2,087,811 | 7/1937 | Patrick | 100/286 |
| 2,108,253 | 2/1938 | Dense | 83/637 |
| 3,520,252 | 7/1970 | Jureit | 100/272 |
| 3,745,868 | 7/1973 | Prentice | 83/630 |
| 3,837,250 | 9/1974 | Lumn | 83/630 |
| 3,919,876 | 11/1975 | Bakermans | 83/630 |
| 3,975,132 | 8/1976 | Keim | 425/406 |
| 3,998,498 | 12/1976 | Portmann | 308/34 |
| 4,089,205 | 5/1978 | Mizumoto et al. | 72/450 |
| 4,129,054 | 12/1978 | Fazis | 83/635 |
| 4,133,260 | 1/1979 | Gundal | 100/257 |
| 4,142,933 | 3/1979 | Graham | 100/208 |
| 4,184,396 | 1/1980 | Hafner | 83/630 |
| 4,318,325 | 3/1982 | Bareis et al. | 83/615 |
| 4,448,119 | 5/1984 | Williamson | 83/630 |
| 4,757,734 | 7/1988 | Portmann | 83/615 |
| 4,903,560 | 2/1990 | Halff et al. | 83/624 |
| 4,920,782 | 5/1990 | Hellwig | 83/630 |
| 5,085,625 | 2/1992 | Kojima | 83/630 |
| 5,425,838 | 6/1995 | Chenoweth et al. | 100/208 |
| 5,481,898 | 1/1996 | Bakermans | 83/630 |
| 5,531,160 | 7/1996 | Eigenmann | 83/615 |

FOREIGN PATENT DOCUMENTS

| | | | |
|---|---|---|---|
| 133779 | 9/1902 | Germany . | |
| 914098 | 7/1949 | Germany . | |
| 1127175 | 4/1952 | Germany . | |
| 3332173 | 8/1984 | Germany . | |
| 67143 | 2/1915 | Switzerland | 83/630 |
| 288398 | 4/1928 | United Kingdom . | |
| 465397 | 5/1937 | United Kingdom | 83/630 |

*Primary Examiner*—Maurina T. Rachuba
*Assistant Examiner*—Sean O. Pryor
*Attorney, Agent, or Firm*—Ladas & Parry

[57] ABSTRACT

A punch press having connecting rods which face away from each other are arranged on the eccentric shaft, and each connecting rod is coupled to a connecting lever. Two toggle joint mechanism units are connected to one connecting lever. Two further toggle joint mechanism units are connected to the other connecting lever extending in the opposite direction. The first named toggle joint mechanism units are connected via pressure columns to a first ram. The second named toggle joint mechanism units are connected via further pressure columns to a second ram. Due to the driving structural members which are arranged symmetrically distributed relative to the eccentric shaft of the punch press and the two rams arrived that thereby, the punch press can feature an extremely long space for receipt of the tools without that the height of the punch press, the allowable rated loading and the moving masses must be held overally large.

4 Claims, 5 Drawing Sheets

PUNCH PRESS HAVING A TOGGLE JOINT MECHANISM DRIVE

BACKGROUND OF THE INVENTION

1. Field of the invention

The present invention relates to a punch press having a frame, at least one ram, a working space, for receiving a web to be processed while being fed through the working space in a set direction of feed along a web feeding plane defined in the working space, a driving mechanism, and an arrangement of toggle joint mechanism units. The toggle joint mechanism units are coupled to the driving mechanism, and are arranged at opposite sides of the driving mechanism in relation to the direction of feed of a web.

2. Description of the prior art In a modern punch technique a punch press is a complete production center. Aside from the common cutting and shaping (bending) operations mounting and assembling operations are also made in punch presses, weldings are performed, parts are bolted together and, furthermore, threads are shaped. After every working step made on a web, the web is fed further in the punch press by a set distance. Furthermore, measuring devices are used for ensuring good quality during the working process. As a result the space for the receipt of tools, that is the punching space, is growing longer in correspondence with the increasing number of processing steps in one punch press. Accordingly, longer and longer spaces for receipt of the tools are needed.

In order to achieve at a longer space for receipt of the tools it basically would merely be necessary to scale up a given design of a punch press. However the allowable rated loading will in such case grow in the power of two and the masses of such scaled up punch press in the power of three.

However, in practical applications higher rated loadings are rarely needed when designing longer spaces for the receipt of tools and extreme increase of the masses and specifically of the moving masses is even undesired.

Accordingly, a scaled up increase of the dimensions of a punch press in order to obtain a longer space for mounting the tools leads to an extremely high financial price of such punch press, to lower rotational speeds, to a larger demand of energy and to poorer control of dynamic mass forces, particularly in producing and working fine and extremely precise products.

SUMMARY OF THE INVENTION

Hence, it is a general object of the present invention to provide an improved construction of a punch press in which the transmittal of force proceeds via toggle joint mechanism units, the punch press having a long space for receipt of tools, high rotational speeds, no higher energy consumption and not overly high dynamic mass forces.

A further object of the invention is to provide a punch press which comprises at least two toggle joint mechanism units located at the same side of the driving mechanism, all the toggle joint mechanism units of the punch press being drivingly connected to at least one ram.

BRIEF DESCRIPTION OF THE DRAWINGS

The present invention will be better understood and objects other than those set forth above will become apparent when consideration is given to the following description thereof. Such description makes reference to the annexed drawings wherein.

DETAILED DESCRIPTION OF THE PREFERRED EMBODIMENT

The embodiment of the invention described hereinbelow encompasses a punch press which is driven by a electromotor and via a coupling-breaking device which is connected to an eccentric shaft. Embodiments are foreseen, however, which include for instance a crank shaft, hydraulic drives, drives having cams, etc.

Figure 5:
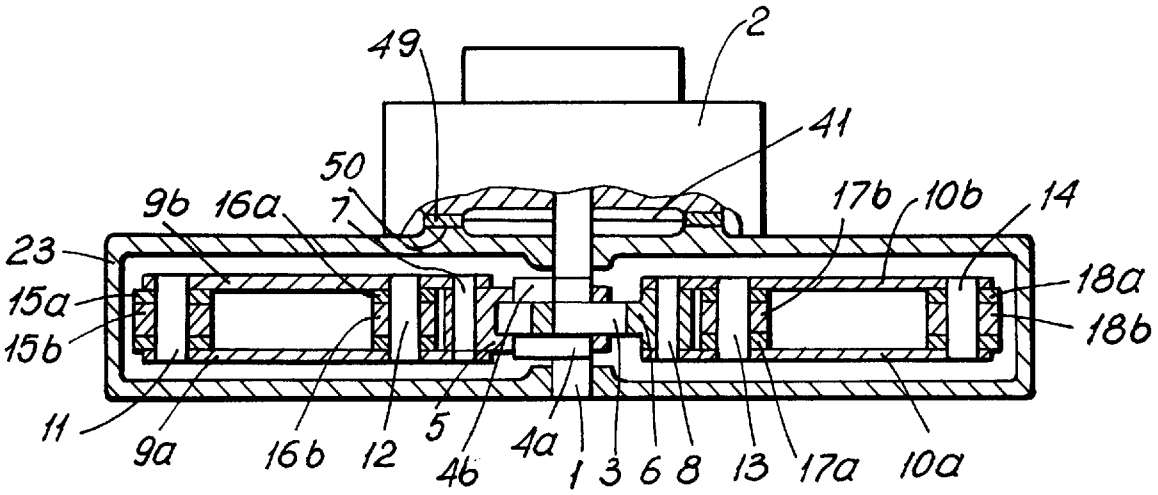
FIG. 5 is a section along line V—V of FIG. 1.

The punch press of the illustrated embodiment includes a eccentric shaft 1. This eccentric shaft 1 is driven by a driving motor 51 via a belt drive 52 and a coupling-breaking device 2. Such coupling-breaking devices for punch presses are generally known such that a detailed description thereof is not needed. FIG. 5 illustrates on a exemplary basis only the breaking disc 51 and the break linings 49, 50 of the coupling-breaking device 2.

The eccentric shaft 1 includes eccentric sections 3, 4*a* and 4*b*. A connecting rod 6 is supported on the eccentric section 3 and a forked connecting rod 5 is supported on the eccentric sections 4*a*, 4*b*. Bushings (not shown) which can be rotated relative to each other in order to adjust the stroke of the ram of the punch press may be arranged around the eccentric sections 3, 4*a* and 4*b* in accordance with designs of a variety of known punch presses.

The connecting rod 5 is pivotally mounted via a pivot pin 7 to a connecting lever 9*a*, 9*b* and connecting rod 6 is pivotally mounted via a pivot pin 8 to a connecting lever 10*a*, 10*b*.

The connecting lever 9*a*, 9*b* is pivotally mounted via a first pin 11 to first levers 15*a*, 15*b* of a toggle joint mechanism unit. Furthermore, the connecting lever 9*a*, 9*b* is pivotally mounted via a second pin 12 to second levers 16*a*, 16*b* of a toggle joint mechanism unit. The connecting lever 10*a*, 10*b* is pivotally mounted via a third pin 13 to levers 17*a*, 17*b* of a further toggle joint mechanism unit. Finally, the connecting lever 10*a*, 10*b* is pivotally mounted via a forth pin 14 to levers 18*a*, 18*b* of a force toggle joint mechanism unit.

The respective upper levers 15*a*, 16*a*, 17*a* and 18*a* of the respective toggle joint mechanism units are supported via eccentric shafts 19, 20, 21 and 22, respectively, at the frame 23 of the punch press.

Figure 1:
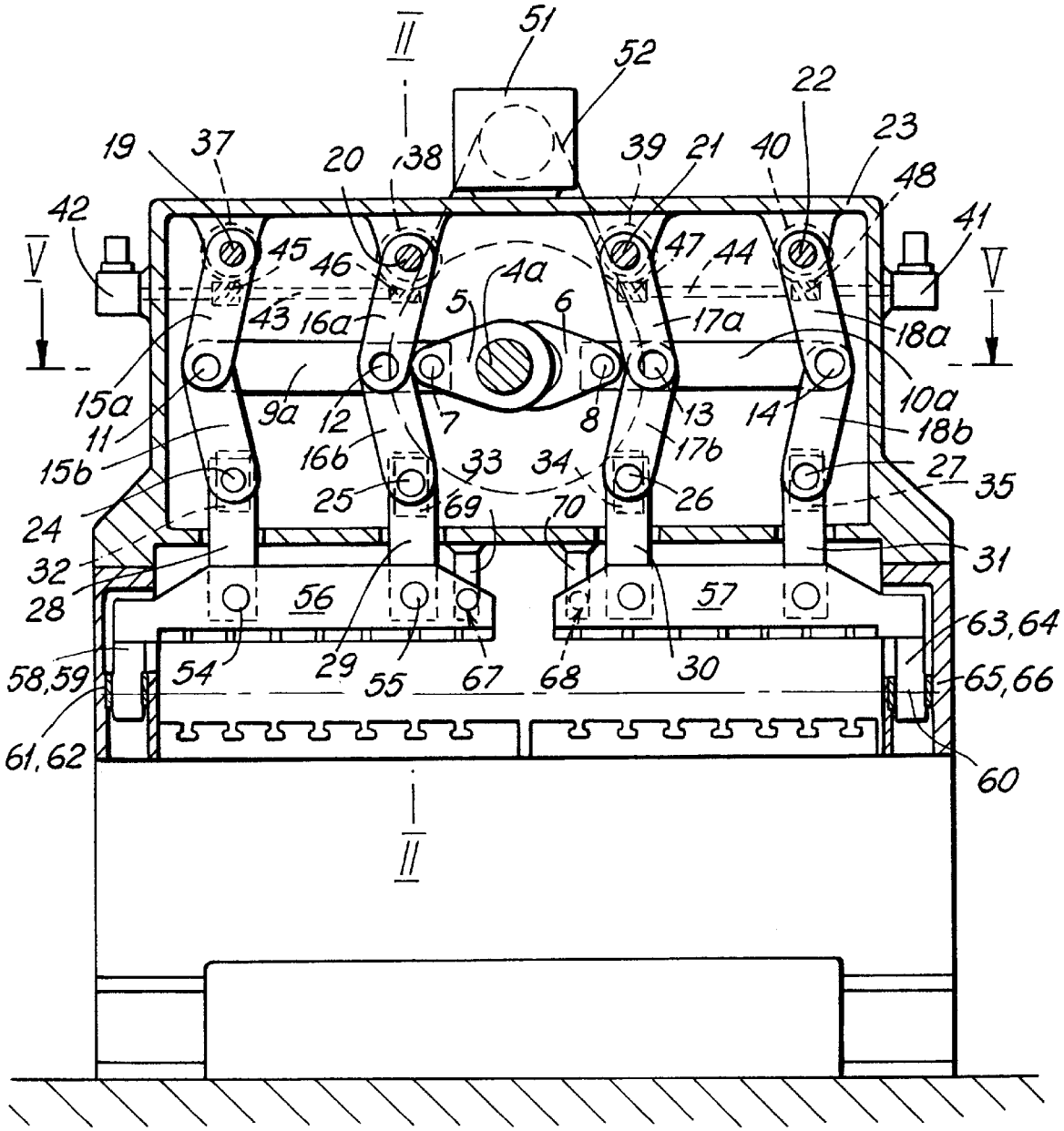
FIG. 1 is a section through a punch press.
Figure 2:
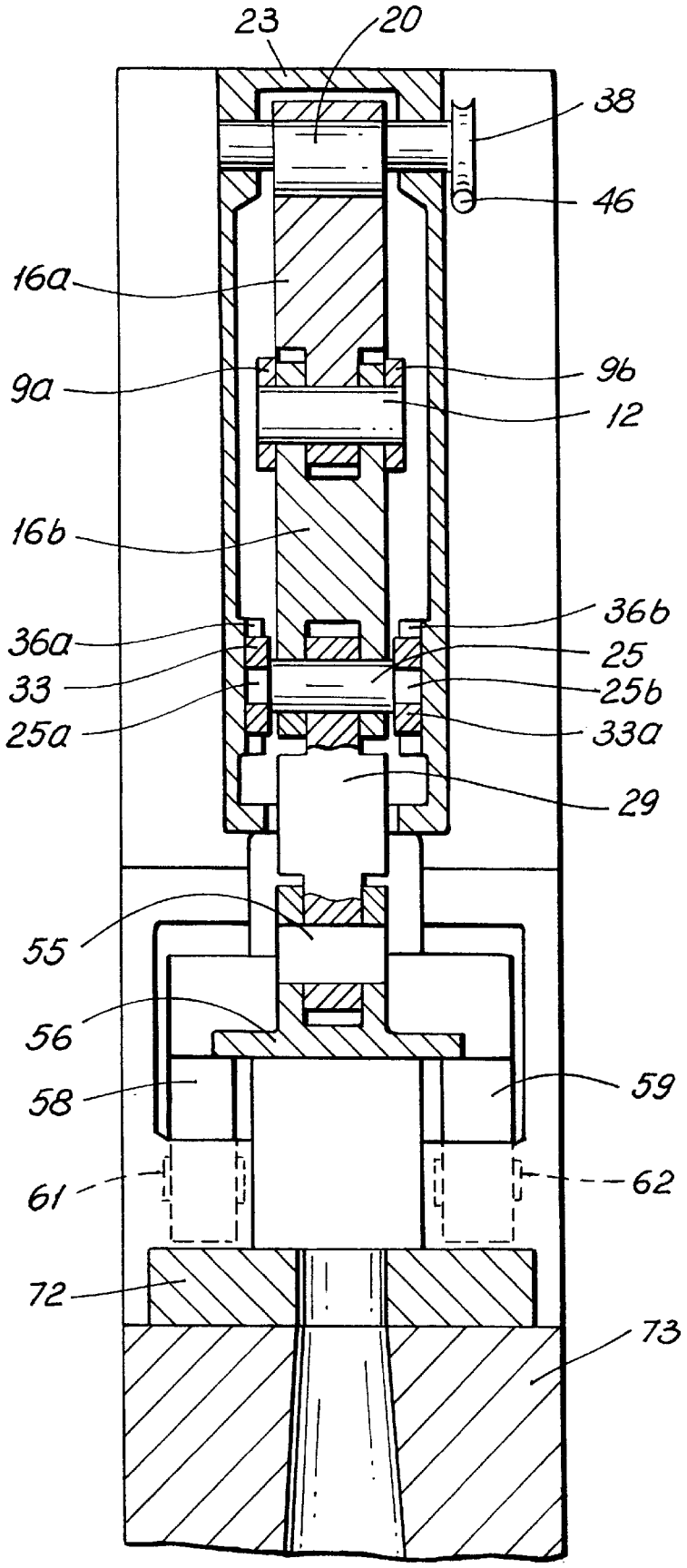
FIG. 2 is a section along line II—II of FIG. 1.

The respective lower levers 15*b*, 16*b*, 17*b* and 18*b* are pivotally mounted via pins 24, 25, 26 and 27, respectively, to pressure columns 28, 29, 30 and 31, respectively. The pins 24, 25, 26 and 27 are supported at their end portions, FIG. 2 illustrates as example the end portions 25*a*, 25*b*, on sliders which are illustrated generally in FIG. 1 by the reference numerals 32, 33, 34 and 35, respectively, and in FIG. 3 generally by the reference numerals 32, 33. In the sectional view of FIG. 2 the respective two sliders of one bolt are illustrated, that is the sliders 33, 33*a* at the two ends of the bolt 25. The sliders 32, 33, 34 and 35 are supported at the frame 23 in grooves which are identified in FIG. 3 generally by the reference numerals 36 and 53 and correspondingly in the sectional view of FIG. 2 by 36*a* and 36*b*.

Reverting again to the upper levers 15*a*, 16*a*, 17*a* and 18*a* of the toggle joint mechanism units it has been mentioned above that they are supported via eccentric shafts 19, 20, 21 and 22 at the frame 23. These eccentric shafts 19, 20, 21 and 22 are mounted to worm-gears 37, 38, 39 and 40. The worm-gears 37, 38, 39 and 40 mesh with worms 45, 46, 47 and 48, respectively. In the illustrated embodiment the worms 45 and 46 are connected via a drive shaft 43 to a servomotor 42 and the worms 47 and 48 are connected via a drive shaft 44 to a servomotor 41.

The pressing columns 28 and 29 which are mounted to the lower levers 15*b* and 16*b* of the toggle joint mechanism units are connected via bolts 54 and 55 to a ram 56 and the pressure columns 30 and 31 are connected to a ram 57.

Alternatively all four pressing columns 28, 29, 30 and 31 could be connected to one single ram or each pressing column could be mounted to just one single ram, such that four rams would be present.

Figure 3:
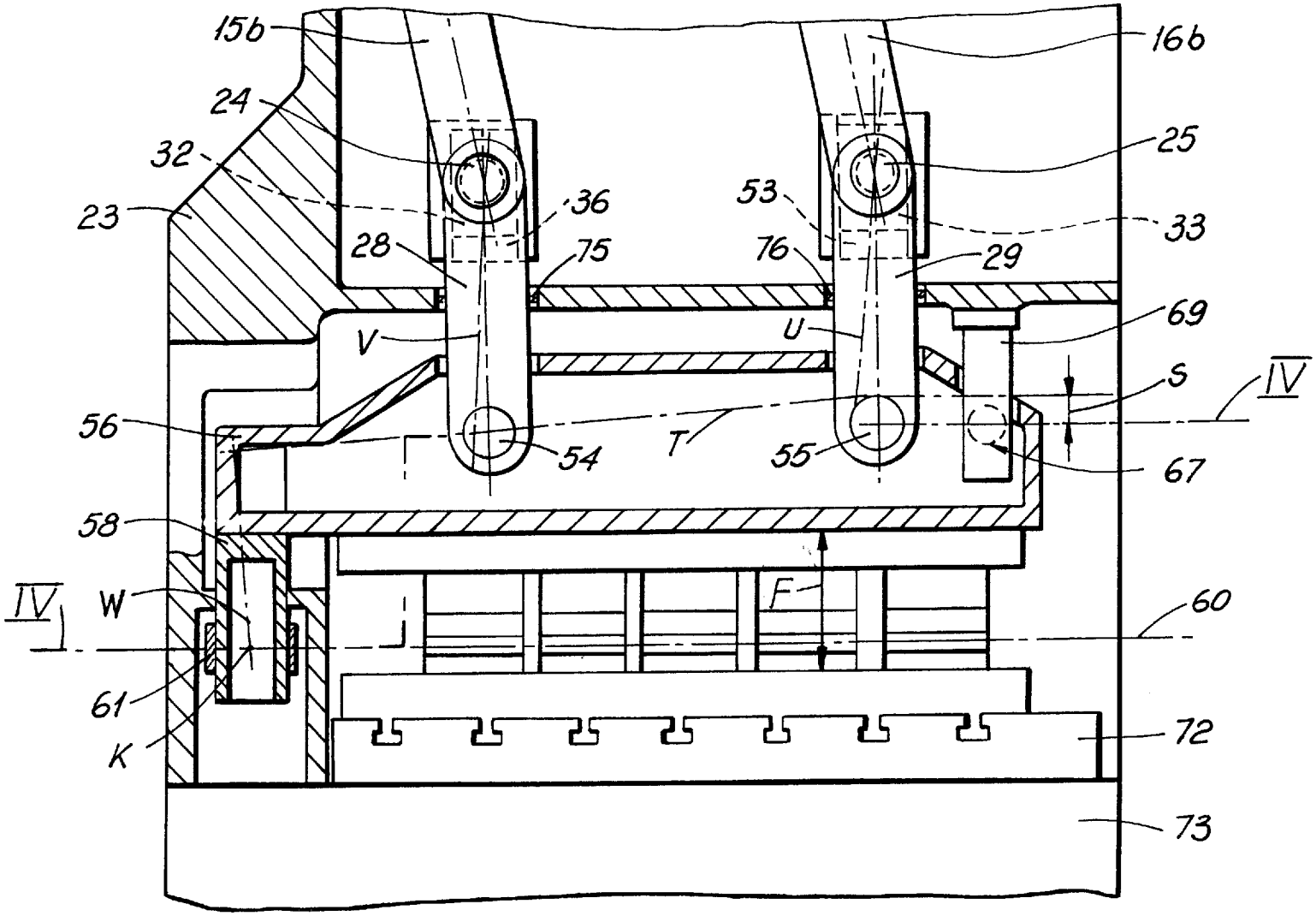
FIG. 3 illustrates on an enlarged scale a detail of FIG. 1.
Figure 4:
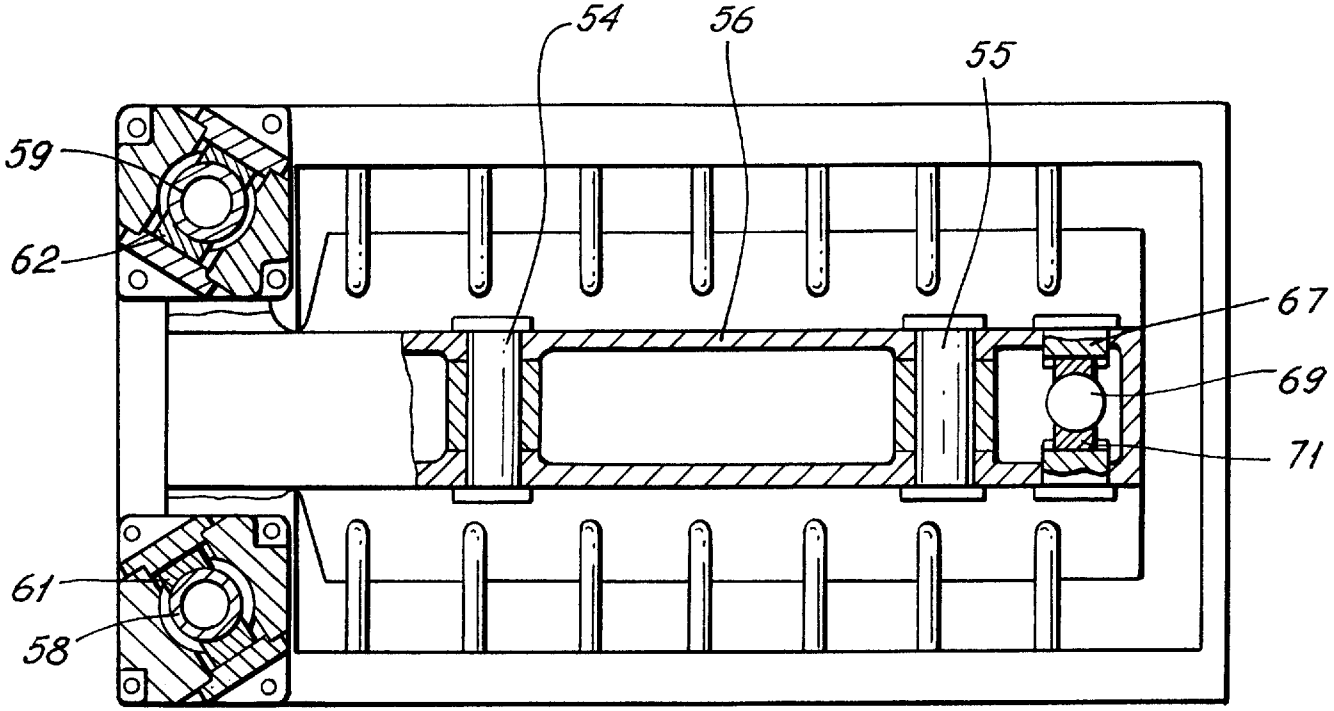
FIG. 4 is a section along line IV—IV of FIG. 3.

Now, the arrangement of the guides of the pressing columns will be described whereby attention is drawn specifically to FIGS. 3 and 4.

The ram 56 is firmly mounted to two guiding columns 58, 59 which project downwards. The guiding columns 58, 59 are guided in the web feeding plane 60 in guides 61, 62. The ram 57 is rigidly mounted to guiding columns 63, 64 and guided in guides 65, 66. This design of guides is disclosed in detail in the Swiss-patent specification CH-A-568,848 and in the US-PS-3,998,498 which disclosures are to be considered to be incorporated herein by reference thereto.

The rams 56, 57 include additionally a further, thus third guide 67 and 68, respectively which guides are located above the web feeding plane 60. Further guide columns 69, 70 which are firmly mounted to the frame 23 of the press project into these third guides 67 and 68, respectively. The guides 67, 68 comprise sliding surfaces 71 (FIG. 4) (see above mentioned documents) which extend in the longitudinal direction of the punch press, i.e. in the direction of the feed of a web. Accordingly, this guides 67, 68 prevent a pivoting of the rams 56, 57 in a direction laterally of the punch press, allow, however, due to the sliding surfaces 71 a thermal expansion of the rams 56, 57 without causing a jamming at the ram guides of the rams 56, 57.

The lower tool mounting plate of the punch press is identified in the figures by the reference numeral 72 and its base plate by the reference numeral 73.

If, during a punching operation, a force F (FIG. 3) occurs which is off-center relative to the longitudinal direction of the punch press, i.e. the direction of the feed of a web, and acting e.g. between the ram 56 and the lower tool mounting plate 72 or base plate 73, the pressing columns 28, 29 are elastically deformed differently relative to each other. The ram 56 moves into an oblique position such as identified by the line S in FIG. 3 whereby the (exaggeratedly illustrated) oblique position of the ram 56 is illustrated by the broken line T. The elastic deformation and the change of the position of the pressing column 29 is illustrated by the broken line U and correspondingly of the pressing column 28 by the broken line V. Furthermore, the oblique position of the guiding column 58 is illustrated by the broken line W.

Because now the guides 61, 62 are located at the plane 60 of feed of a web the pivot point K of the ram 56 remains at the plane 60 of the feed of a web. This results in the fact, that the ram 56 and the tool 74 (upper tool) connected thereto do not pivot in the plane 60 of the feed of a web.

The guide 67, e.g. its sliding surfaces 71 (FIG. 4) allow a corresponding shifting. The seals 75, 76 between the frame 23 of the press and the pressing columns 28, 29 are movable seals which prevent also in case of an oblique position of the ram 56 a flowing of lubricant out of the closed frame 23 of the punch press into the working space and soiling the web to be worked upon and the tools.

Above, the behavior of the various structural members has been described in case of an off-center loading of the ram 56. The same behavior of the corresponding structural members occurs in case of a off center loading of the ram 57.

The ram 56 is coupled via the pressure columns 28, 29 and the levers 15*a*, 15*b* and 16*a*, 16*b*, respectively, of the toggle joint mechanism units to the eccentric shafts 19 and 20, which as described above, are coupled to a common drive, the servomotor 42. The ram 57 is correspondingly coupled via the pressure columns 30, 31 and the levers 17*a*, 17*b* and 18*a*, 18*b*, respectively, of the toggle joint mechanism units to the eccentric shafts 21 and 20, which in turn are connected to the servomotor 41. It, thus, can be seen that the height positions of the two rams 56 and 57 can be set or adjusted, respectively, independently from each other. Obviously, the servomotors can also be operated in synchronism such that the height position of the rams 56 and 57 can also be adjusted in synchronism.

While there is showed described a present referred embodiment of the invention it is to be distinctly understood that the invention is not limited thereto but may be otherwise variously embodied and practiced within the scope of the following claims.

I claim:

1. A punch press comprising:

a frame;

two rams for processing a web;

a working space for receiving said web, said web being fed through said working space in a space in a direction along a web feeding plane in said working space;

a driving mechanism supported from said frame;

pressing columns; and toggle joint mechanism units coupled to opposite sides of said driving mechanism in relation to said direction, at least two of said toggle joint mechanism units being located at each of said opposite sides of said driving mechanism;

wherein each of said toggle joint mechanism units includes first levers and second levers, each of said second levers being pivotally mounted at one end to one end of a respective one of said first levers which is coupled to said driving mechanism for stroking said rams, an opposite end of said first levers being pivotally supported from said frame and an opposite end of each of said second levers being secondly pivotally mounted to one end of a respective one of said pressing columns, each of which is pivotally mounted at its opposite and to a corresponding one of said rams, and said second pivotal mounting of each of said second levers being by a pivot pin, said pivot pin being guided by guide means supported from said frame to be movable in a direction of said stroking of said rams and to be unmovable in a direction lateral relative to said direction of said stroking of said rams;

wherein each of said rams includes at an area two guiding columns located at a distance from each other, said guiding columns being mounted to said frame and guided at said web feeding plane; and further comprising at said end area of each of said rams one further guiding column located at a distance from said two guiding columns, said further guiding columns being rigidly mounted to said frame to project into guiding units in said rams above said web feeding plane so that each of said rams is guided at three locations.

2. The punch press of claim 1, and further comprising two more of the toggle joint mechanism units pivotally mounted respectively to each ram.

3. The punch press of claim 2, wherein the driving mechanism comprises eccentric shafts respectively coupled to first and second drives respectively for the toggle joint mechanism units on the opposite sides of the driving mechanism so that the height positions of the rams may be adjusted.

4. The punch press of claim 1, wherein the driving mechanism includes two connecting rods projecting from a driving unit in opposite directions from each other and driven from the driving unit in opposite senses, the connecting rods being drivingly connected to the toggle joint mechanism units by respective connecting levers.

* * * * *